US007367568B2

(12) United States Patent
Lansel

(10) Patent No.: US 7,367,568 B2
(45) Date of Patent: May 6, 2008

(54) FOUR WHEEL MECHANICAL BRAKE SYSTEM FOR INLINE SKATES

(76) Inventor: Toby Lansel, 4152 East Pender Street, Burnaby, BC (CA) V5C 2M2

( * ) Notice: Subject to any disclaimer, the term of this patent is extended or adjusted under 35 U.S.C. 154(b) by 126 days.

(21) Appl. No.: 10/520,993

(22) PCT Filed: Jul. 8, 2003

(86) PCT No.: PCT/CA03/01030

§ 371 (c)(1),
(2), (4) Date: Aug. 29, 2005

(87) PCT Pub. No.: WO2004/004847

PCT Pub. Date: Jan. 15, 2004

(65) Prior Publication Data

US 2006/0097465 A1 May 11, 2006

Related U.S. Application Data

(60) Provisional application No. 60/394,284, filed on Jul. 9, 2002.

(51) Int. Cl.
*A63C 17/14* (2006.01)

(52) U.S. Cl. ..... 280/11.19; 280/11.221; 280/11.204; 280/11.211

(58) Field of Classification Search ..... 280/11.19, 280/11.204, 11.211, 11.214, 11.215, 11.217, 280/11.221, 11.224
See application file for complete search history.

(56) References Cited

U.S. PATENT DOCUMENTS 5,320,367 A * 6/1994 Landis ..... 280/11.212
5,398,948 A * 3/1995 Mathis ..... 280/11.19
5,938,213 A * 8/1999 Gignoux ..... 280/11.211
6,010,136 A * 1/2000 Hoskin ..... 280/11.214
6,065,761 A * 5/2000 Gignoux et al. ..... 280/11.214
6,089,579 A 7/2000 Pellegrini, Jr. et al. .... 280/11.2

(Continued)

*Primary Examiner*—Christopher P. Ellis
*Assistant Examiner*—Brian Swenson
(74) *Attorney, Agent, or Firm*—Seed IP Law Group PLLC

(57) ABSTRACT

A mechanical brake system for inline skates that utilizes all four wheels for braking. The brake is applied by the skater straightening the leg, or both legs if there are brakes on both skates, to a predetermined adjustable position. This causes the adjustable and spring loaded trigger rod, mounted on the pivoting ankle support behind the heel to push the brake lever that extends from behind the heel on both sides of the frame to the front where it is hingedly attached to move downwards. At the mid-point of the skate the brake rail positioned above the wheels and extending the whole length of the skate is connected to the brake lever. The downward movement of the brake lever and brake rail causes the brake rail to contact the wheels causing friction and thereby braking in direct proportion to the force by which the skater is straightening the leg(s). The brake rail is inflexible and shaped to fit the curvature of the wheels thereby facilitating even wheel wear both regarding shape and diameter. Two brackets mounted on the underside of the skate and passing through slots in the brake rail ensure centering of the brake rail. The spring loading of the trigger rod ensures smooth and controllable braking. The spring tension of the spring loaded trigger rod is adjustable so that skaters with different body weight can have optimum braking power without wheel lock-up.

5 Claims, 3 Drawing Sheets

U.S. PATENT DOCUMENTS

| | | | | |
|---|---|---|---|---|
| 6,131,920 | A | 10/2000 | Roman et al. | 280/11.2 |
| 6,254,109 | B1 * | 7/2001 | Horton | 280/11.214 |
| 6,279,922 | B1 * | 8/2001 | Gaster | 280/11.221 |
| 6,283,481 | B1 * | 9/2001 | Roman et al. | 280/11.214 |
| 6,598,887 | B2 * | 7/2003 | Haldemann | 280/11.221 |
| 6,666,462 | B2 * | 12/2003 | Bellehumeur et al. | 280/11.215 |
| 2001/0054803 | A1 | 12/2001 | Haldemann | 280/11.221 |

* cited by examiner 8C
8A
7
11
8
11A
10
12
9
12C
6A
14
12A
8B
13
15A
15D
16
16A

FIG. 3
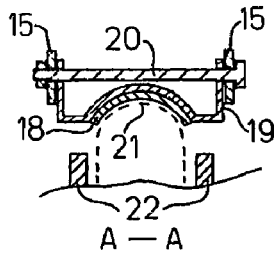
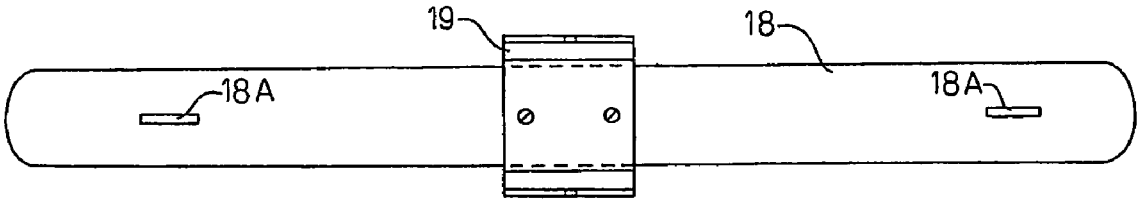
FIG. 4

FOUR WHEEL MECHANICAL BRAKE SYSTEM FOR INLINE SKATES

BACKGROUND ART

This invention relates to a brake system for inline skates and seeks to improve the inline skaters stability when braking, and also to provide smooth and effective braking.

Inline skate brakes presently in use are almost exclusively limited to a piece of rubber mounted behind the heel of one of the skates.

In order to brake, the skater has to lift the front of the skate thus having only one wheel rolling on the ground while pushing the rubber piece to the ground.

Rolling on one wheel with one skate becomes an unstable position. This instability is further increased when scraping the rubber piece on the ground.

One improved brake system uses a lever device to push the rubber piece to the ground when the lower leg is straightened without having to lift the front of the skate, thus rolling on all wheels, greatly improving stability, but still having rough and ineffective braking.

DISCLOSURE OF THE INVENTION

This invention seeks to provide smooth and effective braking on one or both skates without having to lift the front of the skate off the ground.

By utilizing a pivoting ankle support as a trigger mechanism for the brake, the brake is applied when the skater straightens the leg into a "braking position." The exact angle of the leg when the brake is applied is adjustable with the threaded, spring-loaded trigger rod behind the heel.

A brake lever extends from behind the heel on both sides of the frame towards the front where it is hingedly attached to the frame.

At the mid-point of the skate the brake lever is hingedly attached to a bracket that is connected to the brake rail which extends the whole length from the first to the last wheel above the wheels, where it is held in position a short distance from the wheels by a return spring behind the heel that pushes the brake lever and brake rail upwards.

The brake rail is securely centered by two brackets extending downwards from the underside of the skate passing through slots in both ends of the brake rail.

When braking the skater straightens the leg to a predetermined adjustable position causing the lower end of the spring-loaded trigger rod to push the brake lever downwards, which in turn causes the brake rail to contact the wheels generating friction, and thus braking on all wheels in direct proportion to the force applied when the leg is straightened.

The spring loading of the trigger rod is necessary in order to accomplish smooth and easily controllable braking.

The spring tension is adjustable so that maximum braking can be achieved for skaters with different body weights without the wheels locking up and skidding.

BRIEF DESCRIPTION OF THE DRAWINGS

FIG. 3 is the upper portion of a section taken on A-A of FIG. 1.

FIG. 4 is a plan view of the brake rail with the bracket required for connecting the brake rail to the brake lever mounted on the brake rail.

BEST MODE FOR CARRYING OUT THE INVENTION

Figure 1:
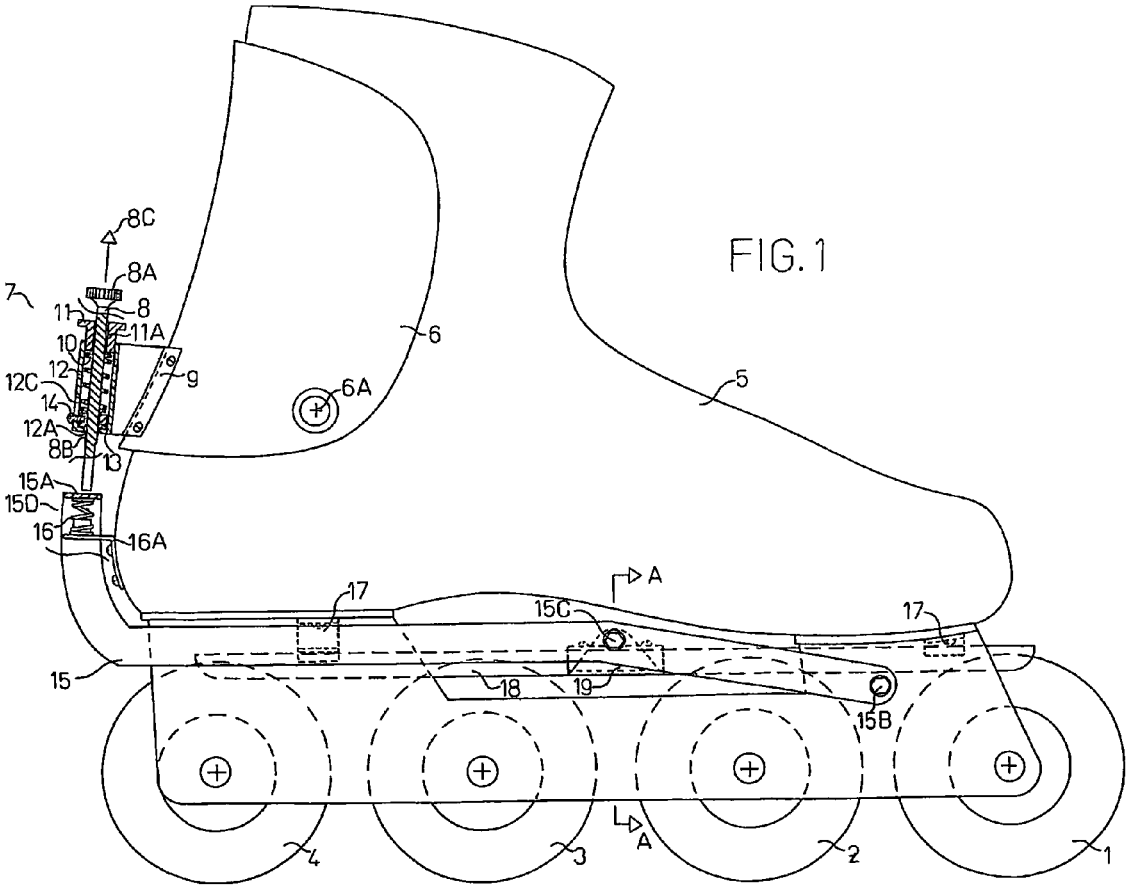
FIG. 1 is an elevational view of an inline skate with the herein described "four wheel mechanical brake system" disengaged.

In FIG. 1, 5 indicates an elevational side view of an inline skate with the herein described "four wheel mechanical brake system" disengaged.

1, 2, 3 and 4 indicate the skate wheels.

6 is the pivoting ankle support.

6A is the pivot point.

Figure 2:
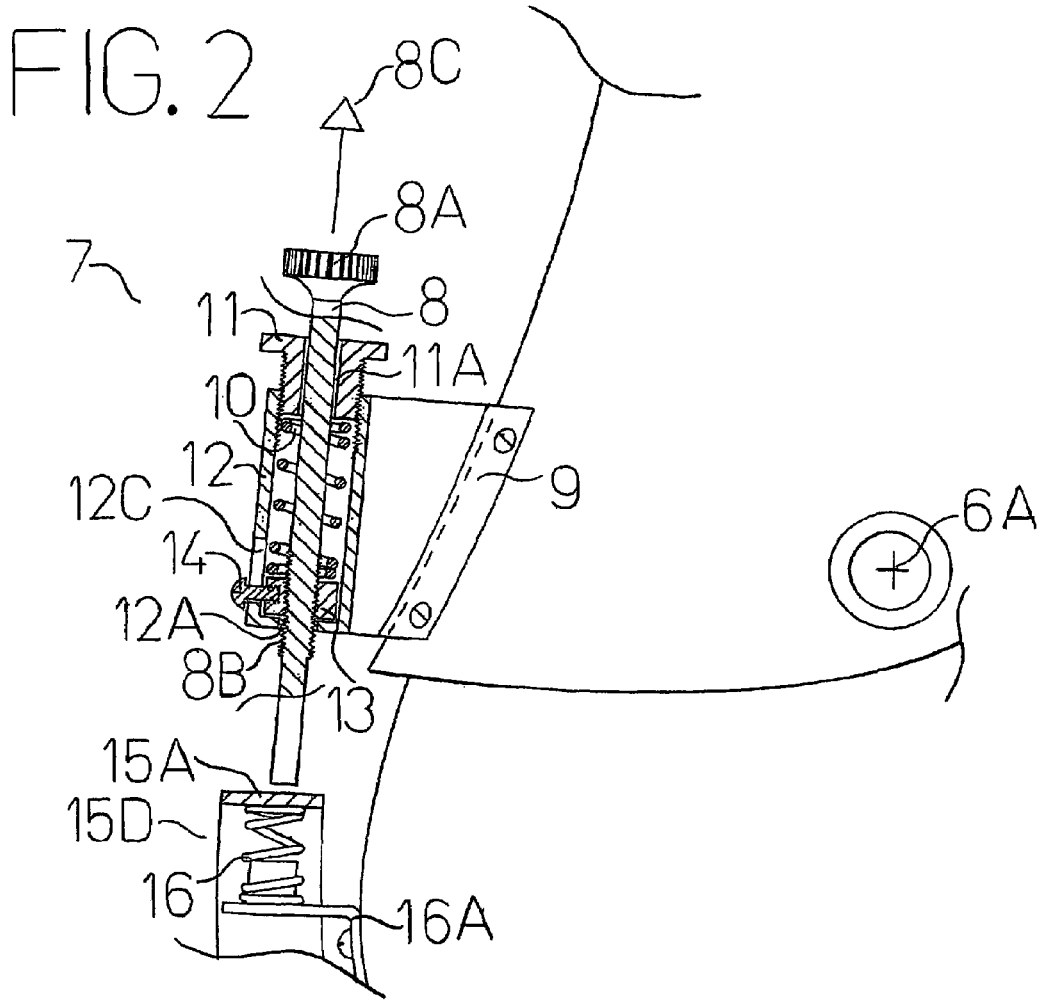
FIG. 2 is an enlarged portion of FIG. 1 showing greater clarity of detail of the trigger assembly.

See FIG. 2 for greater clarity of detail of the trigger assembly.

7 is a lengthwise sectional view of the trigger assembly.

8 is the trigger rod.

8A is the adjustment knob of the trigger rod.

8B is the threaded lower portion of the trigger rod. The arrow 8C indicates the direction of movement of the trigger rod, when the trigger spring 10 becomes somewhat compressed during braking.

9 is the mounting bracket for the trigger assembly.

10 is the trigger spring.

11 is the trigger spring adjustment nut.

11A is the center hole in the trigger spring adjustment nut that accommodates the vertical movement of the trigger rod 8.

12 is the tubular spring housing.

12A is a hole in the bottom of the spring housing for the trigger rod.

13 is the trigger rod adjustment slide with the center hole threaded for trigger rod adjustments.

14 is the rotational stop screw for the trigger rod adjustment slide.

12C is a slot in the trigger spring housing to accommodate the vertical movement of the stop screw 14 when braking.

15 is the brake lever.

15A is a horizontal shelf connecting the right and left side of the brake lever.

15B is the hinged attachment to the skate frame.

15C is the hinged attachment to the bracket 19 that connects the brake lever 15 and the brake rail 18.

15D is a view of the rearmost portion of the brake lever with a piece of the right side cut off.

16 is the return spring for the brake lever 15 and brake rail 18.

16A is the mounting bracket for the return spring.

17 is the centering guide brackets for the brake rail 18.

19 is the bracket that connects the brake lever 15 and the brake rail 18.

FIG. 3 is a sectional view of the upper portion of a section taken at A-A in FIG. 1.

15 is the brake lever.

18 is the brake rail.

19 is a bracket attached to the brake rail that connects the brake lever 15 and the brake rail 18.

20 is the bolt and nut connecting the brake lever 15 and the bracket 19.

21 is a broken outline of the skate wheels indicating the position of the skate wheels relative to the brake rail 18 in a disengaged position.

22 is the skate frame.

FIG. 4 is a plan view of the top side of the brake rail 18 with the bracket 19 attached. 18A are the slots in the brake rail that accommodates the centering guide brackets 17 (See FIG. 1).

The brake is applied by the skater straightening the leg or legs if both skates are equipped with brakes, to a predetermined adjustable position.

The exact angle of the leg when the skater wants to apply the brake is determined by adjusting the trigger rod up or down with the adjustment knob 8A. Wheel wear is also compensated for by the trigger rod adjustment.

The straightening of the leg causes a downward movement of the whole trigger assembly 7 mounted behind the heel on the pivoting ankle support 6.

When braking, the lower end of the trigger rod 8 contacts the horizontal shelf 15A of the brake lever 15 and pushes it downwards as it hinges at 15B.

This in turn causes the brake rail 18 to be pushed against the skate wheels because of the hinged attachment to the brake lever 15 at the mid-point of the skate through the connecting bracket 19.

Braking power is directly proportionate to the force applied by the skater when straightening the leg.

In order to accomplish smooth and controllable braking the trigger rod 8 is spring-loaded by the trigger spring 10.

Spring tension is adjustable with the trigger spring adjustment nut 11, so that skaters with different body weights can achieve optimum braking without the wheels locking up.

When not braking the brake lever 15, and thereby the brake rail 18 is held in the disengaged position by the brake lever and brake rail return spring 16.

The brake lever and brake rail return spring 16 is a weaker spring than the trigger spring 10 which causes the downward movement of the brake lever 15 and brake rail 18 when braking.

The inflexible brake rail 18 conforming to the shape of the periphery of the skate wheels (see FIG. 3) facilitates even wheel wear both regarding the shape of the wheel's contact area with the ground and their diameter.

The brake rail 18 is securely centered in position by two brackets 17 (see FIG. 1) extending downwards from the underside of the skate passing through slots 18A (see FIG. 4) in both ends of the brake rail 18.

Somewhat increased wheel wear is, of course, an unavoidable fact with this brake system, very much depending on the amount and intensity of braking done by the skater.

This brake system is not intended to extend the use of skates from presently relatively flat ground to steeper roadways, since excessive friction heat build-up in the brake rail would be very damaging to the wheels.

However, for safety and convenience, and as encouragement to beginner skaters to take up the sport it could be very useful and potentially trigger a renewed popularity boom for inline skating.

I claim:

1. A braking system for inline skates comprising:

a brake lever; and a brake rail;

said brake lever extending from behind a heel of a skate towards a front portion of the skate where said brake lever is hingedly connected to a skate frame, said brake rail positioned inside said skate frame above a plurality of wheels including a front wheel and a rear wheel, and said brake rail extending between the front wheel and the rear wheel and hingedly connected to said brake lever at a mid portion between the front wheel and the rear wheel.

2. The braking system of claim 1, wherein the braking system is activated by means of a rearward movement of a pivoting ankle support, whereby a downward force is transferred to a rear portion of said brake lever, causing a downward movement of both said brake lever and said brake rail, said brake rail thereby contacting the plurality of wheels causing braking by means of a frictional restriction of rotational movement of said plurality of wheels in direct proportion to the downward force applied to said rear portion of said brake lever, said downward force being directly proportional to a force by which a lower leg is straightened.

3. The braking system of claim 1, wherein the brake rail facilitates even wheel wear both regarding lateral curvature and diameter of the plurality of wheels by means of said brake rail being inflexible and by means of a section of said brake rail conforming to said lateral curvature of said plurality of wheels.

4. The braking system of claim 1, further comprising:

means to prevent contact between said brake rail and plurality of wheels when said braking system is not activated.

5. The braking system of claim 1, further comprising:

means of brake activation comprising a vertically adjustable trigger rod mounted behind the heel on a pivoting ankle support, said brake activation means adjustable in relation to a forward leaning angle of said pivoting ankle support by means of adjusting said trigger rod up or down corresponding to a pre-selected forward leaning angle of said pivoting ankle support for brake activation, said trigger rod provided with means for adjustable and resilient contact pressure against a rear portion of said brake lever.

* * * * *